US006591993B2

(12) United States Patent
Humphrey

(10) Patent No.: US 6,591,993 B2
(45) Date of Patent: Jul. 15, 2003

(54) ROTATING LAMP SHADE DISPLAY CAROUSEL SYSTEM

(75) Inventor: Neall W. Humphrey, El Dorado Hills, CA (US)

(73) Assignee: Trade Source International, El Dorado Hills, CA (US)

( * ) Notice: Subject to any disclaimer, the term of this patent is extended or adjusted under 35 U.S.C. 154(b) by 0 days.

(21) Appl. No.: 09/850,332

(22) Filed: May 7, 2001

(65) Prior Publication Data

US 2002/0162812 A1 Nov. 7, 2002

(51) Int. Cl.[7] ..... A47F 7/00

(52) U.S. Cl. ..... 211/85.14; 211/163; 211/144; 211/36

(58) Field of Search ..... 211/85.14, 163, 211/77, 78, 70, 33, 37, 115, 95, 33.5, 144

(56) References Cited

U.S. PATENT DOCUMENTS 1,242,305 A * 10/1917 Arey ..... 175/85
2,081,856 A * 5/1937 Frick ..... 211/131.1
3,963,126 A * 6/1976 Taub ..... 211/131.1
4,170,843 A * 10/1979 Talwani ..... 211/1.53
4,426,010 A * 1/1984 Le Mer ..... 108/94
4,694,132 A * 9/1987 Liu ..... 108/20
4,822,118 A * 4/1989 Watkins ..... 312/244
4,858,772 A * 8/1989 Phillipson ..... 211/115
5,031,779 A * 7/1991 Szenay et al. ..... 211/163
5,052,563 A * 10/1991 Camp ..... 211/163
5,054,624 A * 10/1991 Camp ..... 211/163
5,101,738 A * 4/1992 Sideris ..... 108/94
5,357,871 A * 10/1994 Bowman ..... 108/27
5,479,867 A * 1/1996 Blevins et al. ..... 108/22
5,493,976 A * 2/1996 Hammond ..... 108/50.12
5,562,216 A * 10/1996 Falconio ..... 211/131.1
5,839,586 A * 11/1998 Smith ..... 211/163
5,996,819 A 12/1999 Klein ..... 211/85

* cited by examiner

*Primary Examiner*—Blair M. Johnson
*Assistant Examiner*—Khoa Tran
(74) *Attorney, Agent, or Firm*—Oppenheimer Wolff & Donnelly, LLP

(57) ABSTRACT

A rotating lamp shade display system including a carousel having a main body portion having an upper surface and an underside for receiving a plurality of shades on upper surface, a main body portion rotating means is mounted to the underside of said main body portion whereby said main body portion rotates about said rotating means. A plurality of said shades are placed on the main body portion for display.

1 Claim, 6 Drawing Sheets

FIG. 4
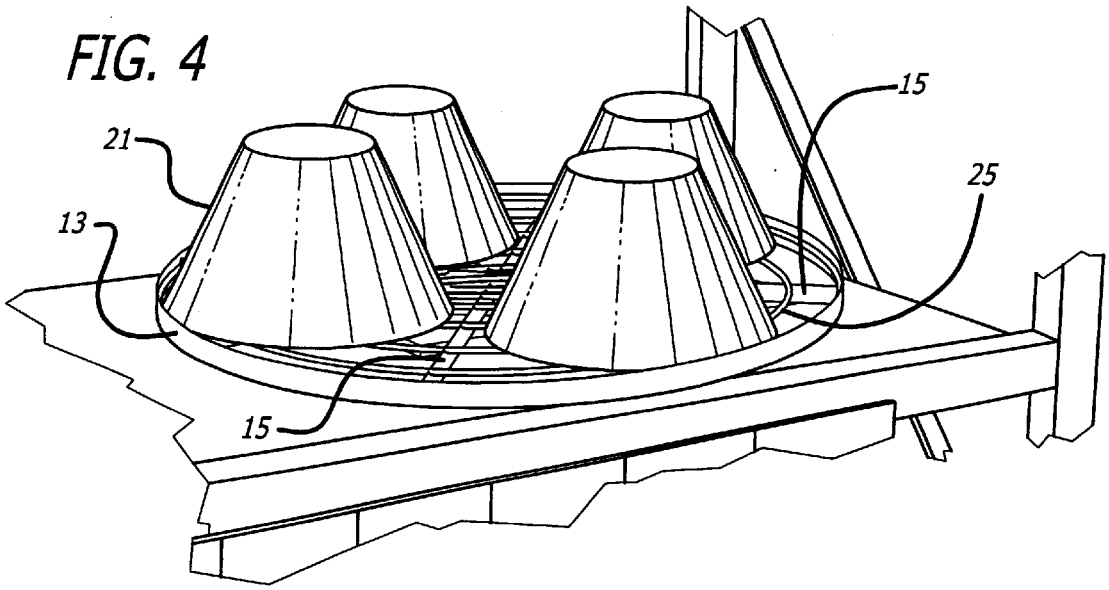
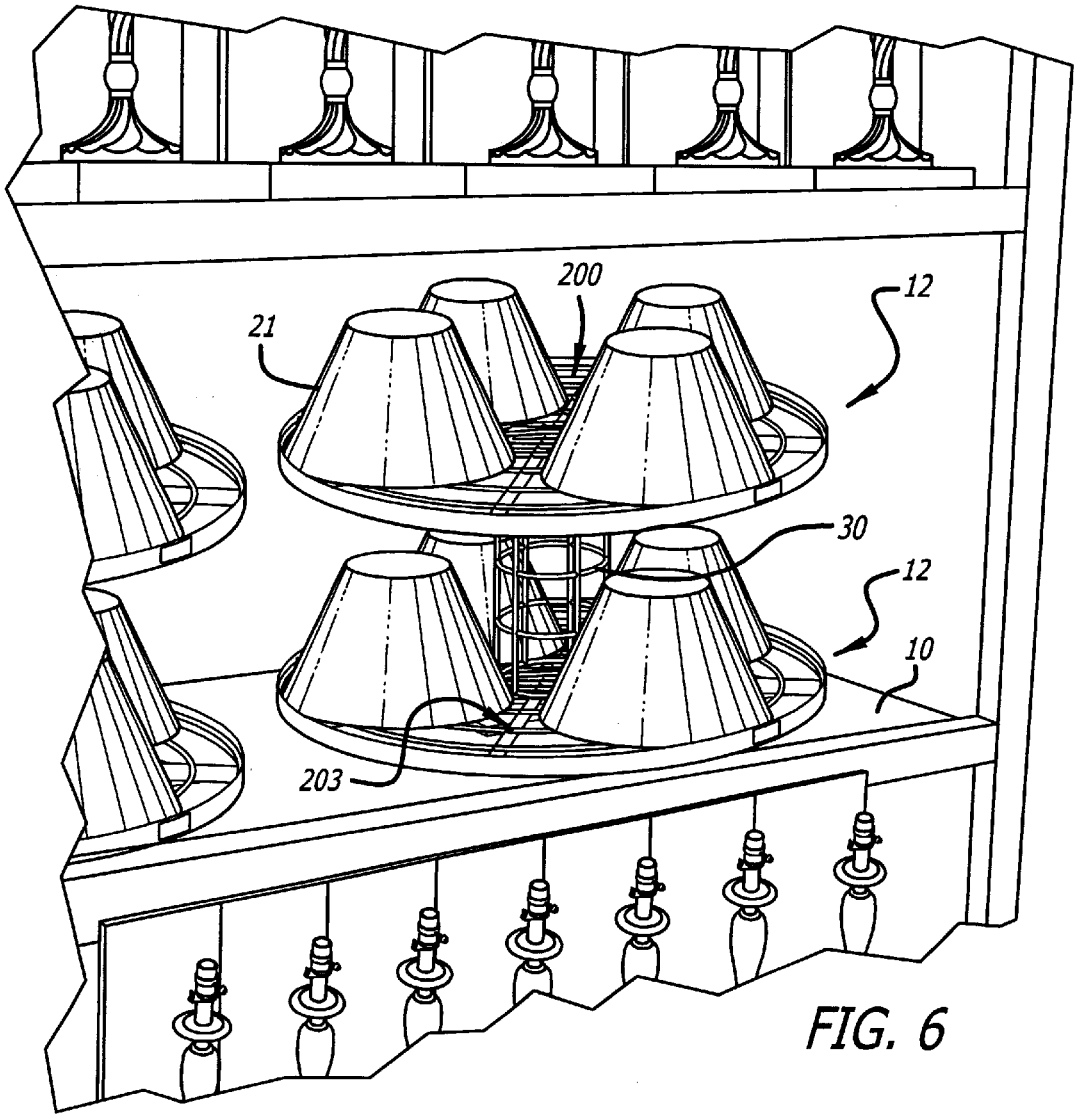
FIG. 6

ROTATING LAMP SHADE DISPLAY CAROUSEL SYSTEM

BACKGROUND OF THE INVENTION

1. Field of the Invention

The invention relates to product displays and, more particularly, to a rotating lamp shade display carousel.

2. Related Art

Current shade display methods for portable lamps include stacking the shades on top of one another and then placing them on a shelf in a store or the like. In such displays, the shades are traditionally stacked on a shelf and have additional stock of the same shade on the shelf behind the first item. In warehouse or mass merchant types of retail establishments, dust and debris collect on the shelves and on the products which causes damage to the product and requires additional maintenance.

Problems inherent with these traditional methods of displaying shades include the fact that, first, shades take up a lot of valuable shelf space. When shades are stacked in the traditional manner on a shelf, only a product of the same item is stacked behind the front facing which takes up valuable space and only allows for one shade style to be presented to the customer. This limits the number of shades that can be presented to the customer by the retailer.

Second, where a retailer has deep shelving, it is very difficult for store personnel to bring stock from the back of the shelves forward for presentation.

Third, traditional methods for displaying shades utilize a flat surface which gathers dust and debris quickly, thus requiring substantial effort by store personnel to frequently dust and remove such debris to maintain a clean presentation to the customer and prevent damage to the product.

In U.S. Pat. No. 5,996,819 to Klein, there is shown a display stand for lamp shades. However, this display is a self-standing display which does not accommodate itself to a retailer's existing shelving. It is relatively expensive and the shades are mounted on posts which might damage the same. The posts allow only a certain amount and size of shades to be placed on the display.

There is this need for a type of display unit that will allow the customer to easily select a lamp shade and will not take up excessive amounts of valuable space in the retail establishment nor require additional maintenance from store personnel. Such a unit should be usable on the retailer's pre-existing shelving or free-standing. It should be able to accommodate shades of differing sizes.

INVENTION SUMMARY

It is an object of this invention to provide a rotating lamp shade carousel system for product display.

It is further the object of this invention to provide such a carousel system which does not take up an excessive amount of the retail establishment's pre-existing display space.

It is another object to provide the retailer with the opportunity to maximize the shade selection to the customer by providing a larger selection of shades within the same amount of space.

It is yet another object to reduce the amount of maintenance necessary to display such lamp shades.

These and other objects are preferably accomplished by providing a rotating lamp shade carousel for product display.

BRIEF DESCRIPTION OF THE DRAWINGS

FIG. 4 is a perspective view of the carousel system of FIG. 1 showing a plurality of shades disposed thereon;

FIG. 6 is a perspective view of another embodiment of the invention showing a plurality of interconnected carousel systems having shades disposed thereon;

DETAILED DESCRIPTION OF THE PREFERRED EMBODIMENTS

Figure 1:
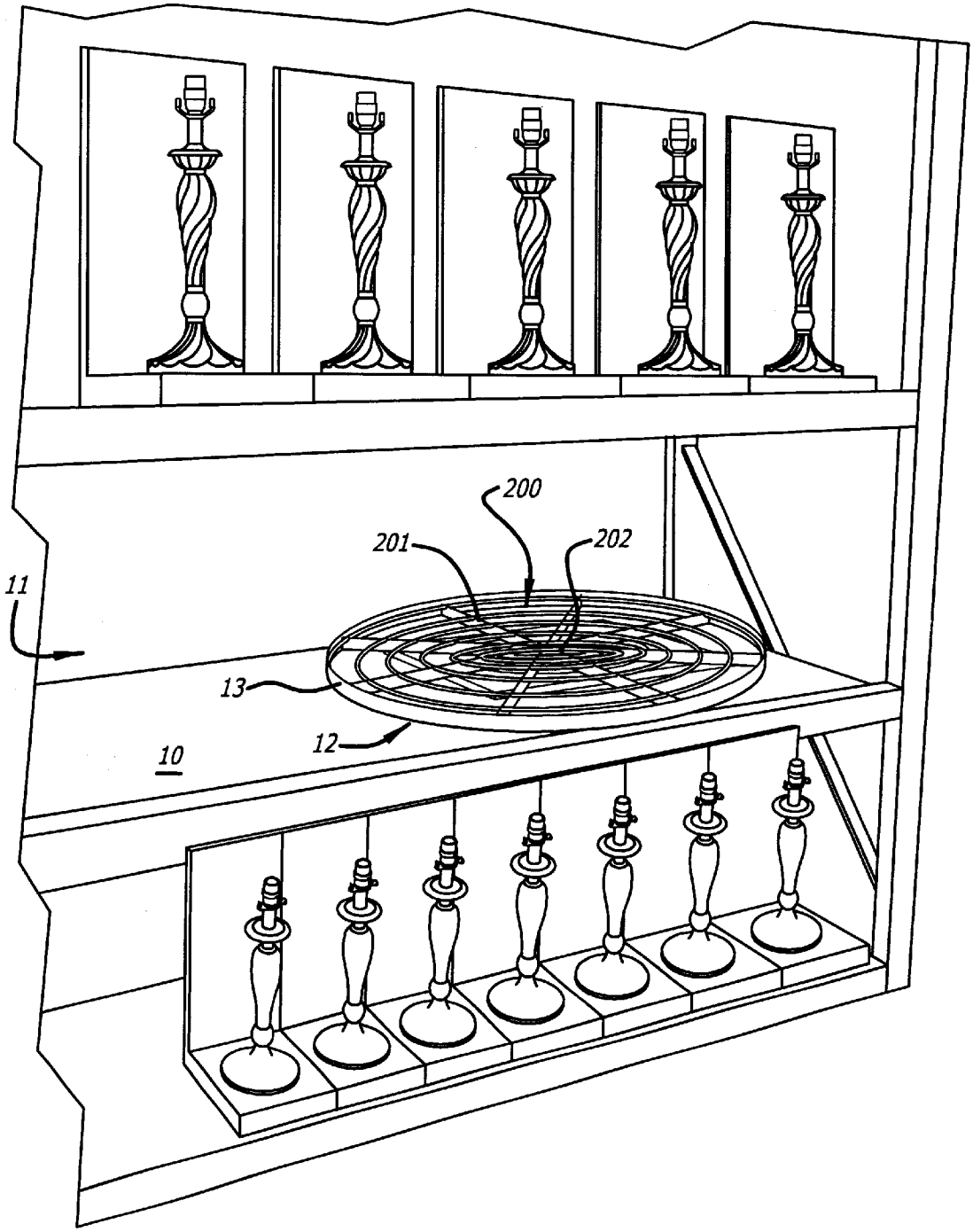
FIG. 1 is a perspective view of a single carousel system in accordance with the teachings of the invention disposed on the shelf of a rack.

Referring now to FIG. 1 of the drawing, a conventional store display shelf 10 is shown on a rack 11. A lamp display carousel system 12 is mounted thereon in accordance with the teachings of the invention.

Figure 2:
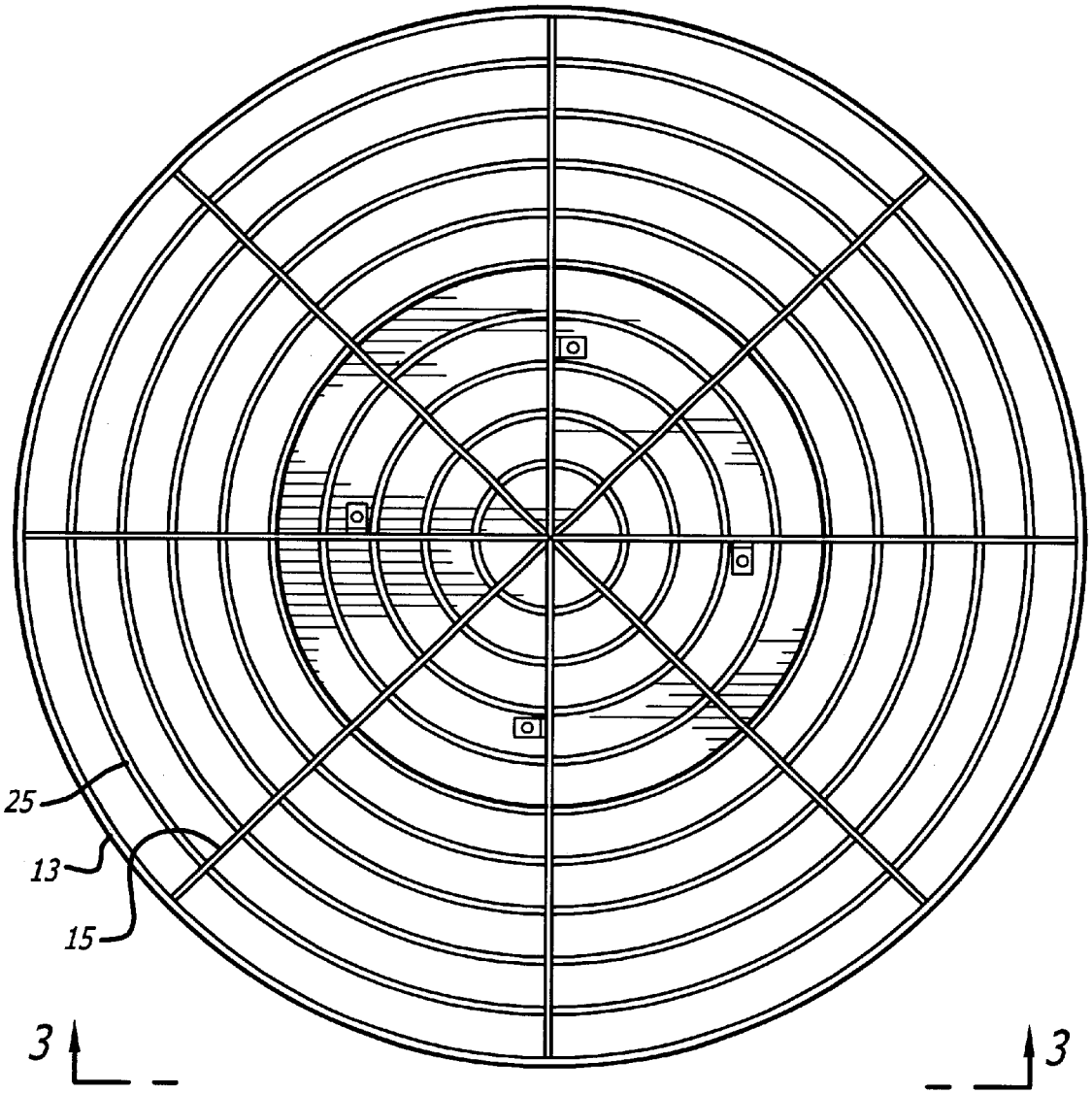
FIG. 2 is a top plan view of the carousel system alone of FIG. 1.

Carousel system 12 includes a main body portion 200 having an upper surface 201 comprised of a generally circular peripheral outer rim 13 (see also FIG. 2) and a plurality of ribs 5 interconnecting rim 13 at the central hub of carousel system 12. A plurality of arcuate flanges 25 extend between ribs 5 about the carousel system 12.

Figure 3:
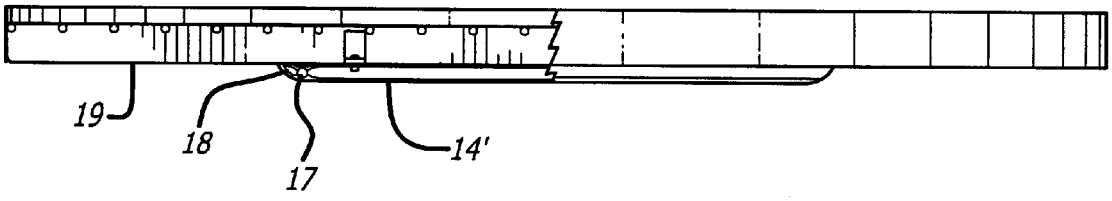
FIG. 3 is a view through lines 2—2 of FIG. 2.

As seen in FIG. 3, a mounting board 14' may be mounted on the underside 19 of carousel system 12. Alternatively, the underside 19 of carousel system 12 may merely rest on top of board 14'.

Carousel system 12 includes a plurality of ball bearings 17 mounted in races 18 retained between the undersurface 19 of carousel system 12 by board 14. Thus, carousel system 12 rotates on ball bearings 17 on board 14.

As seen in FIG. 4, rim 13 and ribs 15 extend above the flanges 25 for reasons to be discussed.

Figure 5:
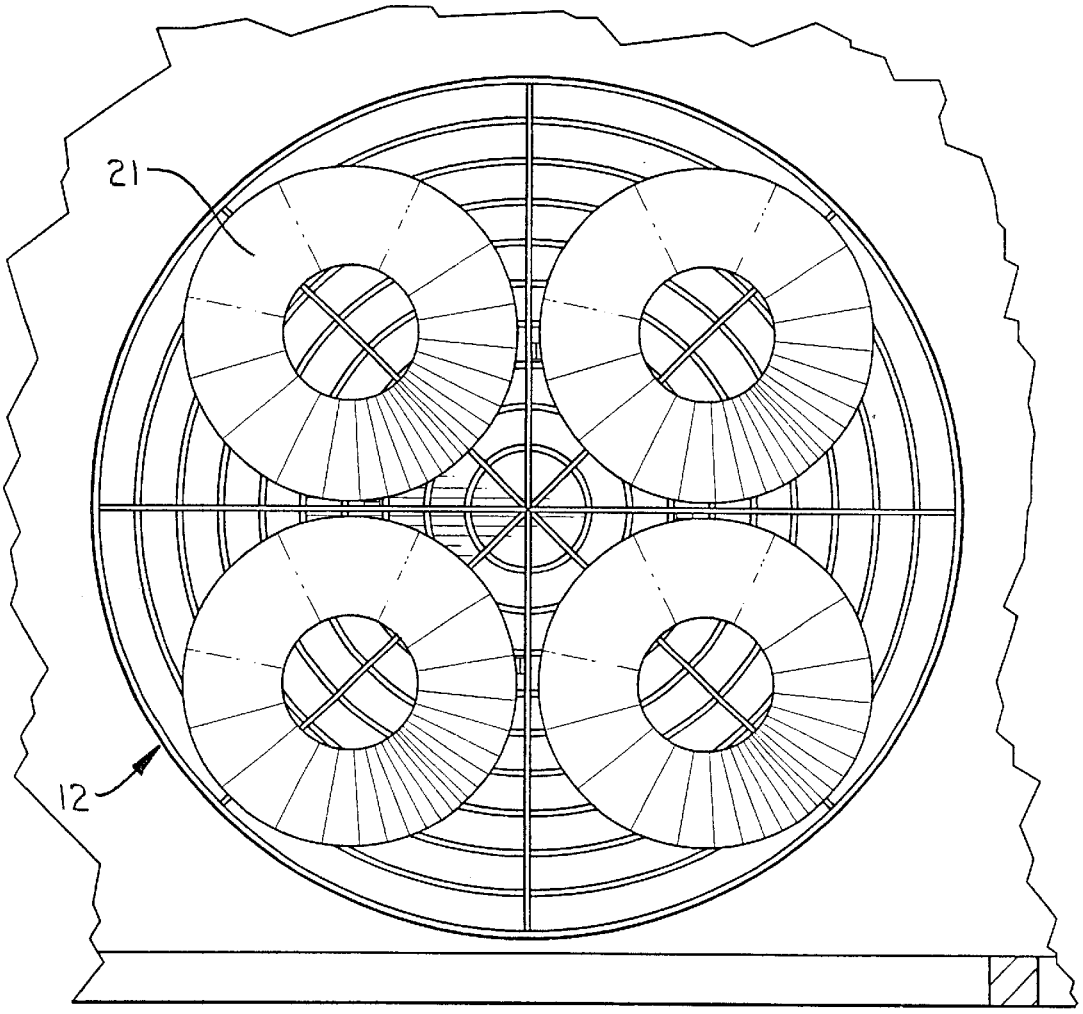
FIG. 5 is a top plan view of the carousel system of FIG. 4.

As seen in FIGS. 4 and 5, a plurality of shades 21 (which may be the same or different) are mounted on carousel system 12 between ribs 15 on flanges 25. Rim 13 keeps the shades 21 from slipping off the carousel system 12. Such shades 21 are generally conically shaped and wider at bottom than at top. Thus, the wider portion rests on flanges 25 between ribs 15 and is retained in position by the fact that rim 13 and ribs 15 extend about the plane of the flanges 25.

Obviously, a plurality of such carousel systems 12 may be disposed side by side on a shelf. In that manner, a plurality of shades may be presented to the shopper.

Although a single carousel system 12 is shown in FIGS. 1 to 5, as seen in FIG. 6, wherein like numerals refer to like numerals of FIGS. 1 to 5, a pair of carousel systems 12 may be mounted on a shelf 10 interconnected by a column or support 30.

Figure 7:
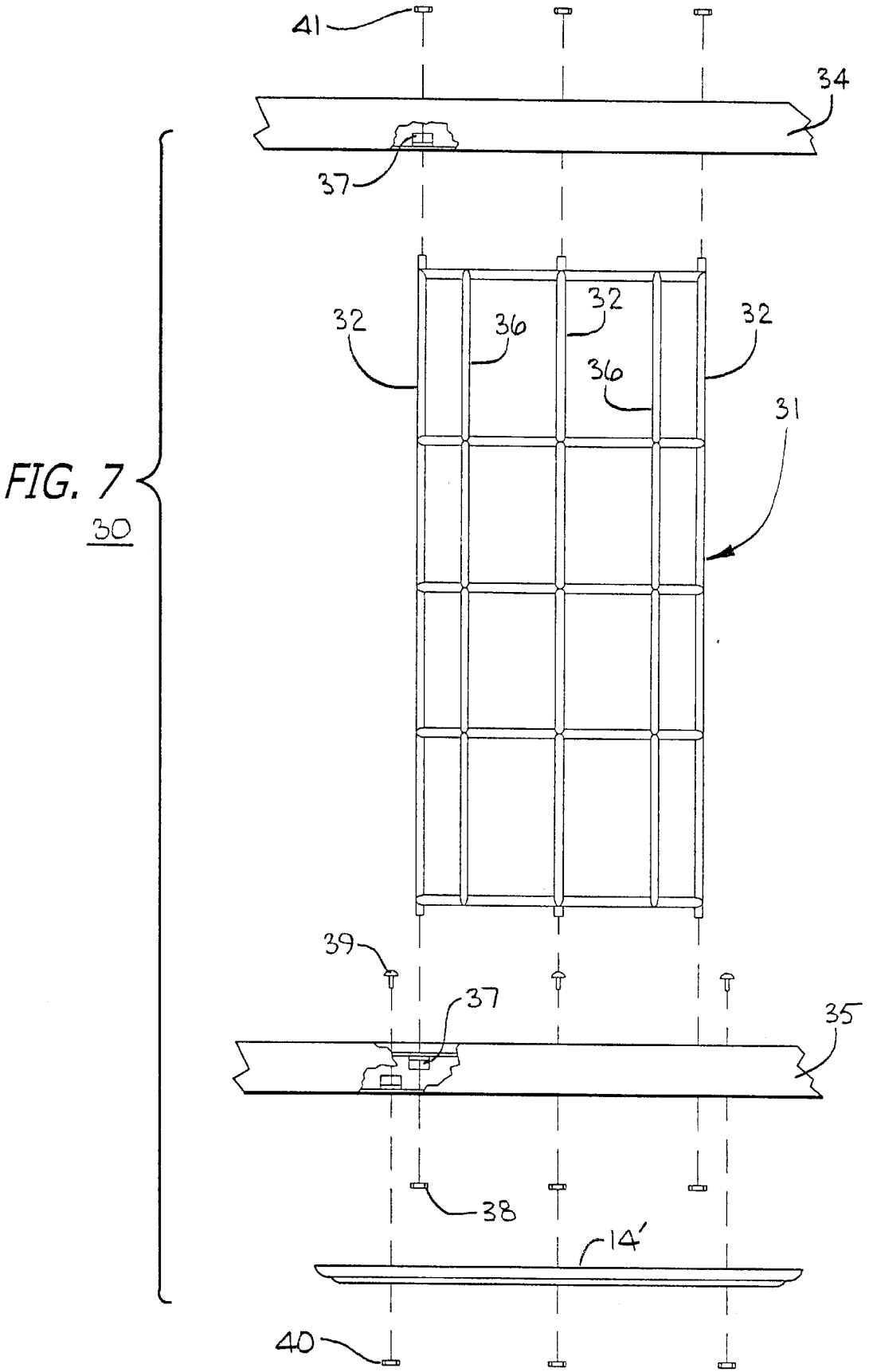
FIG. 7 is an exploded view of the system of FIG. 6.

As seen in FIG. 7, column 30 may be a wire cage 31 having a plurality of main supporting posts 32 connected at top and bottom to a circular rim (rims 34, 35, respectively). Rims 34, 35 are also interconnected by a plurality of vertical spaced members 36 forming a cage. Posts 32, 33 may have conventional pipe nipples 37 at top and bottom which extend at bottom to board 14' and secured thereto by suitable nuts 38. Board 14' is secured to the bottom of lower carousel system 12 by suitable bolts 39 and nuts 40. Nipples 37 at top are secured to the upper carousel system 12 by suitable nuts 41. As can be seen, a second bearing plate system is not needed at top since the entire assembly rotates about the bearing system in the lower unit.

Referring once again to FIG. 6, it can be seen that a plurality of shades 21 are mounted on each carousel system 12 presenting a variety of shades to the customer.

Ribs 15 act as dividers between the shades (but can be eliminated, if necessary) and may extend above the surface of flanges 25 to retain one shade from the other. Rim 13 acts as a lip to retain the shades 21 on each carousel system 12 as the customer rotates the same. Pricing, advertising or other suitable labeling may be attached to rim 13.

A plurality of multilevel carousel systems, as seen in FIG. 6, may be disposed side by side on shelf 10. Further, although a two-tiered system is disclosed in FIG. 6, obviously more than two may be provided, depending on the storage space available.

Although column or support 30 has been shown as an open wire cage, obviously it could be a solid cylinder, if desired. Also, although a ball bearing assembly is disclosed for rotating the carousel, any suitable rotating means may be provided.

Figure 8:
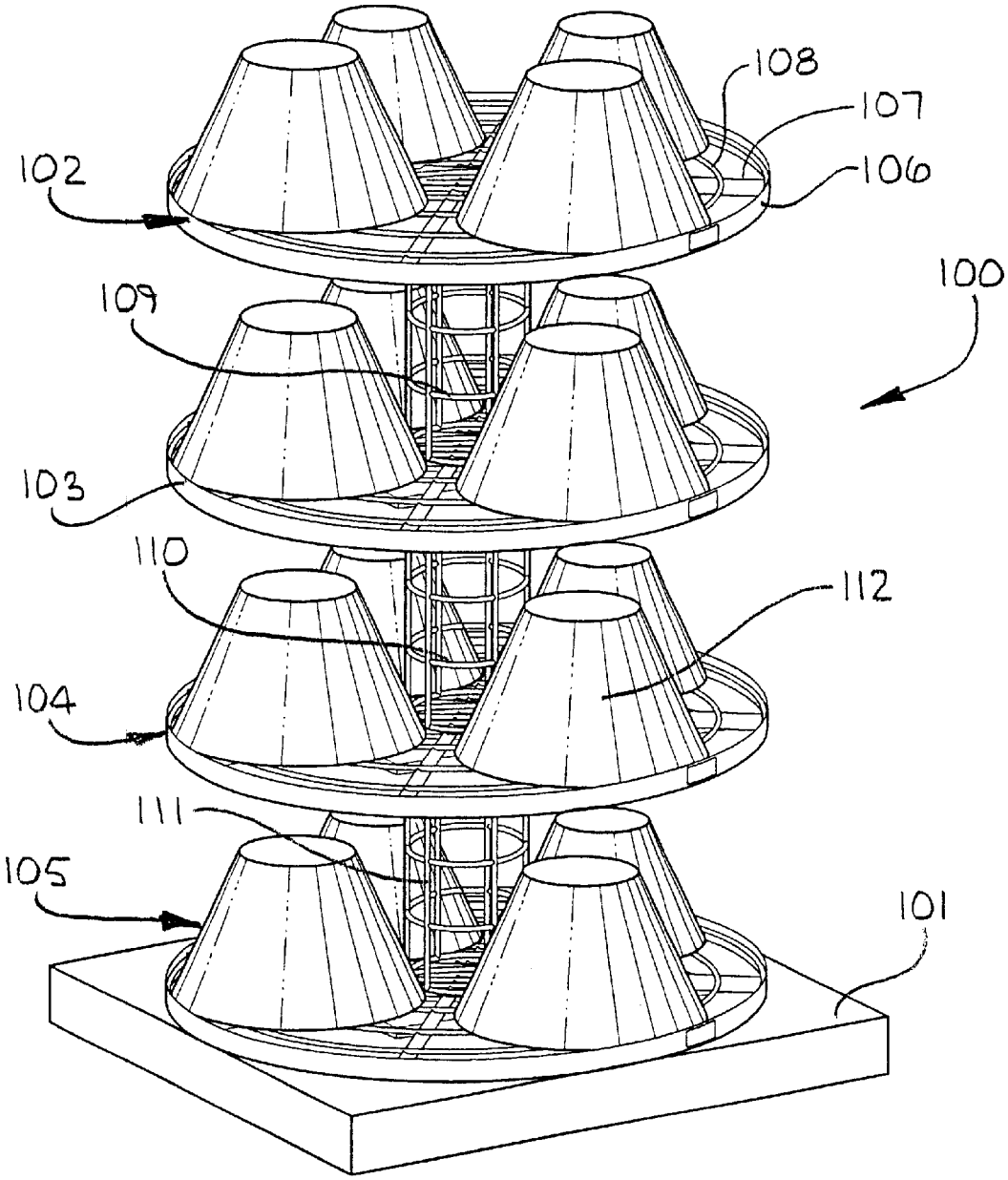
FIG. 8 is a perspective view of another type of carousel system in accordance with the teachings of the invention.

As seen in FIG. 8, a multi-tiered lamp shade display carousel system 100 may be provided. System 100 includes a base 101 which is otherwise identical to the base shown in FIG. 3 and described in paragraph 0026 of this application. A plurality of carousels 102 through 105 are mounted on base 101. Each carousel 102 through 105 include a rim 106, ribs 107 and flanges 108 identical to aforementioned rim 13, ribs 14 and flanges 25, respectively.

A column, such as columns 109, 110 and 111, identical to aforementioned column 30, interconnects adjacent carousels as seen in FIG. 8. Shades 112 are mounted on each carousel 102 through 105. Instead of wire columns 109 to 111, solid cylinders may be used. Also, base 101 may be placed directly on the floor, as a stand-alone unit, or fixed to a pallet. System 100 could thus be 3, 4, 5 or 6 feet high.

It can be seen that there is disclosed a carousel system having a flat surface appropriate for displaying a plurality of shades. The materials used may be plastic, steel, steel grid, perforated or louvered steel, wood, or any other suitable material, mounted to a ball bearing assembly.

The system may be made of wire grid material, louvered or perforated material, either of metal, plastic, wood or other suitable material, which greatly reduces the problem of dust collecting on the same which can soil or otherwise damage the shades and render them unable to be sold. This also reduces the amount of cleaning and maintenance required by store personnel, which is a significant problem in the industry.

The carousel system may include a lip on the outer edge of the carousel base, which will prevent the shades from falling off the carousel system when it is rotated by the customer.

The carousel system may also include dividers of any suitable material such as metal, plastic, cardboard, etc., to separate the various shades that are on the carousel. These dividers may also assist in supporting the shades and preventing them from falling over when the carousel system is rotated by the customer.

The carousel system may include more than one level for displaying shades. Additional levels may be supported by any suitable support means, such as rods forming a cage, or a support cylinder separating each level. Shelves 10 may not be at a set height, depending on the spacing between shelves, the number of levels of carousels may vary.

The carousel shade displaying system of the invention allows multiple shades to be clearly displayed, unlike prior art shade trees, which only allow for three or four shades to be displayed per level.

The carousel shade displaying system herein is designed to be used with conventional pre-existing retail type shelving generally manufactured from 18" up to a 48" depth.

The carousel shade displaying system of the invention reduces the amount of shelf space necessary to display shades by fully utilizing the wasted overstock space traditionally found behind the first shade placed on the shelf. This carousel displaying system provides the retailer with the opportunity to maximize the shade selection to the customer by providing a larger selection of shades within the same amount of space.

Finally, the carousel shade displaying system herein utilizes a bearings unit which provides stability and smooth operation when the carousel system is rotated by the customer.

Although there is disclosed herein a preferred embodiment of the invention, variations of the invention may occur to an artisan, and the scope of the invention should only be limited by the scope of the appended claims.

I claim:

1. A rotating lamp shade display system comprising:

a carousel having a main body portion having an upper surface and an underside, said carousel being adapted to hold a plurality of shades on said upper surface; and a main body portion rotating means having a ball bearing assembly thereon mounted to the underside of said main body portion whereby said main body portion rotates about said ball bearing of said assembly of said rotating means, said main body portion including an upstanding annular peripheral rim interconnected by a plurality of spaced ribs extending from said rim to a central hub, a plurality of spaced flanges interconnecting said ribs, said flanges forming a generally planar surface and said rim extending above the planar surface of said flanges, a second main body portion mounted above said first mentioned main body portion and rotatable therewith, a support interconnecting generally the mid-portions of each of said main body portions, said support being an open wire frame.

* * * * *